US008240621B1

(12) United States Patent
Singh

(10) Patent No.: US 8,240,621 B1
(45) Date of Patent: Aug. 14, 2012

(54) DEVICE TO PREVENT A BAG WITH HANDLES FROM COLLAPSING INSIDE A REFUSE RECEPTACLE

(75) Inventor: Anurag Satyapal Singh, Tustin, CA (US)

(73) Assignee: Playantra LLC, Tustin, CA (US)

( * ) Notice: Subject to any disclaimer, the term of this patent is extended or adjusted under 35 U.S.C. 154(b) by 0 days.

(21) Appl. No.: 13/184,527

(22) Filed: Jul. 16, 2011

(51) Int. Cl.
*B65B 67/04* (2006.01)
*B65D 25/14* (2006.01)

(52) U.S. Cl. ..... 248/99; 248/100; 220/495.11

(58) Field of Classification Search ..... 248/99, 248/95, 100, 154, 500, 506; 220/495.1, 495.08, 220/495.07, 495.11
See application file for complete search history.

(56) References Cited

U.S. PATENT DOCUMENTS

| | | | | | |
|---|---|---|---|---|---|
| 409,239 | A | * | 8/1889 | Roller | 248/304 |
| 579,228 | A | * | 3/1897 | Frame | 141/390 |
| 1,506,668 | A | * | 8/1924 | Rose et al. | 211/107 |
| 2,563,698 | A | * | 8/1951 | Whitebread | 248/499 |
| 3,614,041 | A | | 10/1971 | Koger | |
| 3,927,445 | A | | 12/1975 | Pavlish | |
| 4,576,310 | A | | 3/1986 | Isgar | |
| 4,697,771 | A | | 10/1987 | Majors | |
| 4,723,740 | A | | 2/1988 | Courtemanche | |
| 4,763,808 | A | | 8/1988 | Guhl | |
| 4,834,260 | A | | 5/1989 | Auten | |
| 4,867,401 | A | * | 9/1989 | Graff | 248/99 |
| 4,925,056 | A | * | 5/1990 | McCoig | 220/495.1 |
| 5,054,724 | A | | 10/1991 | Hutcheson | |
| 5,065,891 | A | | 11/1991 | Casey | |
| 5,125,605 | A | * | 6/1992 | Guerrera | 248/100 |
| 5,246,190 | A | | 9/1993 | Swirkal | |
| 5,419,452 | A | | 5/1995 | Mueller | |
| 5,535,914 | A | | 7/1996 | Badalamenti | |
| 5,556,063 | A | | 9/1996 | Boyd | |
| 5,636,416 | A | | 6/1997 | Anderson | |
| 5,662,238 | A | | 9/1997 | Sarno | |
| 5,671,861 | A | | 9/1997 | Hall | |
| 5,711,563 | A | | 1/1998 | Sapp | |
| 5,732,845 | A | | 3/1998 | Armaly | |
| 5,735,495 | A | | 4/1998 | Kubota | |
| 5,758,366 | A | * | 6/1998 | Wilson | 2/338 |
| 5,799,908 | A | * | 9/1998 | Downs | 248/97 |
| 5,803,299 | A | * | 9/1998 | Sealy, Jr. | 220/495.07 |
| 5,881,901 | A | | 3/1999 | Hampton | |
| 5,881,975 | A | * | 3/1999 | Bianco | 248/95 |
| 5,887,748 | A | | 3/1999 | Nguyen | |
| 5,921,427 | A | | 7/1999 | Giannone | |
| 6,012,686 | A | | 1/2000 | Julian | |
| 6,056,147 | A | | 5/2000 | Jarman | |
| 6,286,706 | B1 | | 9/2001 | Tucker | |
| 6,434,800 | B1 | * | 8/2002 | James et al. | 24/298 |
| 6,454,223 | B1 | * | 9/2002 | Rosky | 248/100 |

(Continued)

*Primary Examiner* — Anita M King

(57) ABSTRACT

The device to prevent a bag with handles from collapsing inside a refuse receptacle is a band of stretchable material with plurality of hooks suspended from axis of a band and said hooks move freely along the axis of a band. The circumference of device is less than that of refuse receptacle for which it is being adapted thus it fits snuggly anywhere on the outer surface of refuse receptacle. The plastic bag with handles is secured to a refuse receptacle by inserting closed end of the bag into the refuse receptacle and folding the open end of the plastic bag over the rim of the refuse receptacle such that handles of plastic bag folded down on the side and secured by hooks to prevent plastic bag with handles from slipping over a rim and collapsing inside the refuse receptacle.

7 Claims, 5 Drawing Sheets

U.S. PATENT DOCUMENTS

| | | | |
|---|---|---|---|
| 7,055,224 | B2 | 6/2006 | Bathey |
| 7,243,811 | B1 | 7/2007 | Ramsey |
| 7,404,499 | B1 | 7/2008 | Ramsey |
| 7,604,143 | B2 | 10/2009 | Kerekes |
| 7,641,835 | B2 | 1/2010 | Ramsey |
| 7,694,838 | B2 | 4/2010 | Myk |
| 2005/0017010 | A1 | 1/2005 | Siegel |
| 2008/0005870 | A1 | 1/2008 | Chase |
| 2008/0173648 | A1 | 7/2008 | Escobar |
| 2008/0191103 | A1 | 8/2008 | Thurgar |
| 2009/0050628 | A1 | 2/2009 | Sullivan |
| 2010/0218370 | A1 | 9/2010 | Lin |

* cited by examiner

DEVICE TO PREVENT A BAG WITH HANDLES FROM COLLAPSING INSIDE A REFUSE RECEPTACLE

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF INVENTION

The present invention relates to plastic bags with handles commonly supplied in grocery stores and more particularly relates to devices which can be fitted to existing refuse receptacles for preventing such plastic bag with handles from collapsing inside the receptacle when reused as liner.

Consumers often receive goods, such as groceries and other retail items in plastic bags with handles from stores. These plastic bags with handles come in different sizes and configuration.

Consumers often reuse plastic bags with handles accumulated from their shopping trips as liners for existing refuse receptacles but these bags have tendency to collapse inside the refuse receptacle and leave the gaps for trash to fall through and make inside surface of refuse receptacle dirty. Collapsing of bag sometimes closes the mouth of the bag which requires Consumers to reposition the bag and makes it inconvenient to reuse bags with handles as liner.

Many efforts have been made to provide devices which fit to existing refuse receptacle to prevent afore described plastic bag with handles from collapsing, though they have following limitations, a. They do not tackle different sizes and configuration of afore described plastic bags.
b. They allow gaps between bag and refuse receptacle's wall for trash to fall through inside the refuse receptacle itself instead of plastic bag and make refuse receptacle dirty.
c. They only fit to particular shape of refuse receptacle like rectangular or circular.
d. They only fit to refuse receptacles without having a lid.

By way of example, U.S. Pat. No. 4,763,808 to Guhl discloses a holdfast and support system for an elastic plastic container liner, U.S. Pat. No. 4,723,740 to Courtemanche discloses a support hook for plastic bag, U.S. Pat. No. 5,671,861 to Hall discloses a holder for supporting plastic bags, U.S. Pat. No. 5,887,748 to Nguyen discloses a bag supporting system.

Other attempts have been made to provide a Clip kind of device which has following limitations, a. They require fastening or gluing them to refuse receptacle.
b. Fixing these devices permanently to refuse receptacle limits their flexibility to handle various sizes and configurations of plastic bags with handle.

By way of example, U.S. Pat. No. 4,925,056 to McCoig discloses an apparatus facilitating the use of a plastic grocery bag as a trash container, U.S. Pat. No. 5,419,452 to Mueller discloses a fastening device for container liners.

In this respect, the device of the present invention substantially departs from the concepts and designs of the prior art, and in so doing provides a device primarily developed to fit the existing refuse receptacles of various shapes and sizes and prevent the plastic bag with handles of various configuration and sizes from collapsing inside refuse receptacle when plastic bag with handles reused as refuse receptacle liner.

BRIEF SUMMARY OF THE INVENTION

The device to prevent a bag with handles from collapsing inside a refuse receptacle is a band of stretchable material with plurality of hooks suspended from axis of a band and said hooks move freely along the axis of a band.

The hook has a elliptical eye for suspending it from the axis of a band and curved bent area with gap to secure the handle of a plastic bag.

The band has a circumference less than the circumference of a refuse receptacle for which it is adapted but can be stretched to fit snuggly around the refuse receptacle and thereby secured to a refuse receptacle without the help of fastening mechanism or glue allowing plurality of suspended hooks to be positioned at desired location along the axis of a band.

The band has an inner surface and an outer surface, where an inner surface has non-slip coating preferably in a wave pattern.

The device can be circumscribed anywhere on the outer surface of refuse receptacle to adjust to various configuration and sizes of plastic bags with handle.

Using the device, device is circumscribed on the outer surface of refuse receptacle, a plastic bag with handles is secured to a refuse receptacle by inserting closed end of the bag into the refuse receptacle and folding the open end of the plastic bag over the rim of the refuse receptacle such that handles of plastic bag folded down on the side and secured by hooks to prevent plastic bag with handles from slipping over a rim and collapsing inside the refuse receptacle.

It is therefore a principal object of the present invention to provide a device for existing refuse receptacles which can fit to various shapes and sizes of refuse receptacles with or without the lid to retain bags with handles of various sizes and configuration over a rim of refuse receptacle and prevent it from collapsing inside the refuse receptacle so that consumers can reuse plastic bag with handles as refuse receptacle liner.

It is further object of the present invention to provide a device which does not require any adhesive or fastening system to attach the device to a refuse receptacle.

It is also an object of the present invention to provide quality and economical solution to consumer with an ease of use to reuse plastic bags with handle as refuse receptacle liner instead of just discarding them.

It is an additional object of present invention to provide an easy to use device which stays on outer side of refuse receptacle's surface for quick change of plastic bag with handles.

DETAILED DESCRIPTION OF THE INVENTION

Figure 1:
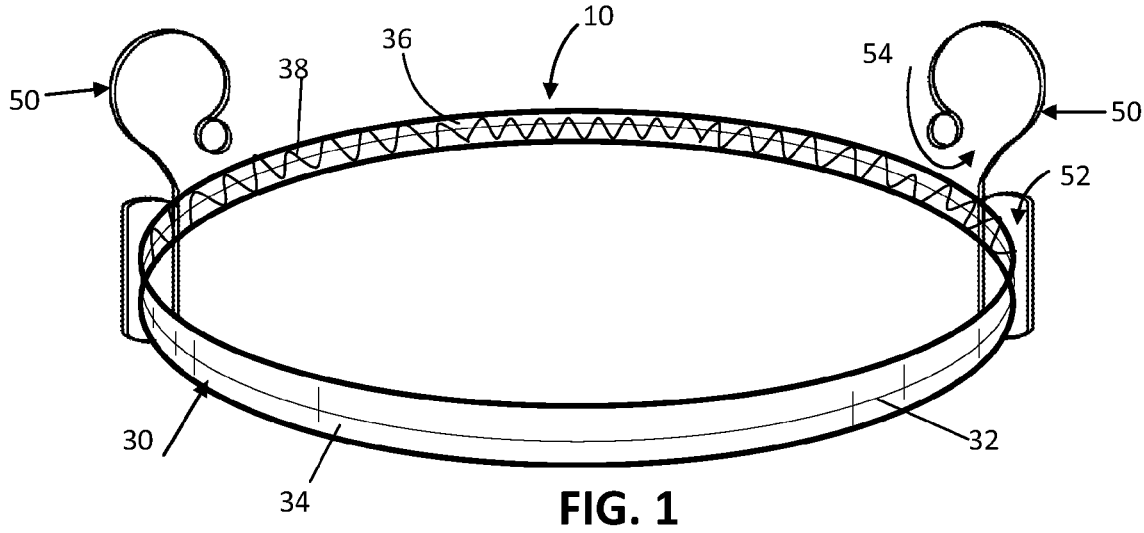
FIG. 1 is a perspective view of a device according to present invention.

The present invention is a device to prevent a bag with handles from collapsing inside a refuse receptacle designated generally as 10 in the drawings. Referring first to FIG. 1 the device comprises a band 30 of elastic material. The band 30 defines an axis 32 which runs along the band 30 through the center of its flat surface. Also, the band 30 is continuous (i.e., the band 30 has no beginning or end point). The band 30 has outer surface 34 and inner surface 36, where said inner surface 36 has non-slip coating 38 of silicone material in wave pattern.

Figure 3:
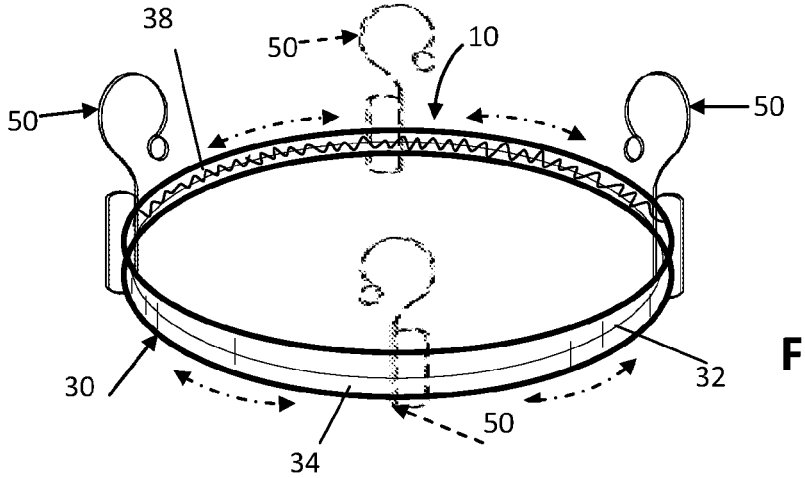
FIG. 3 is a perspective view of a device showing that plurality of hooks can be positioned anywhere along the axis of the band.

As shown in FIG. 1, the device 10 also comprises a plurality of hooks 50 suspended from the axis 32 of the band 30 using elliptical eye 52 of hook 50. As shown in FIG. 3 the hooks 50 are not permanently fixed at a particular point on the axis of the band 30 and can move freely along the axis 32 of the band 30 due to elliptical eye 52 of hook 50 as shown by phantom-lines.

Figure 2:
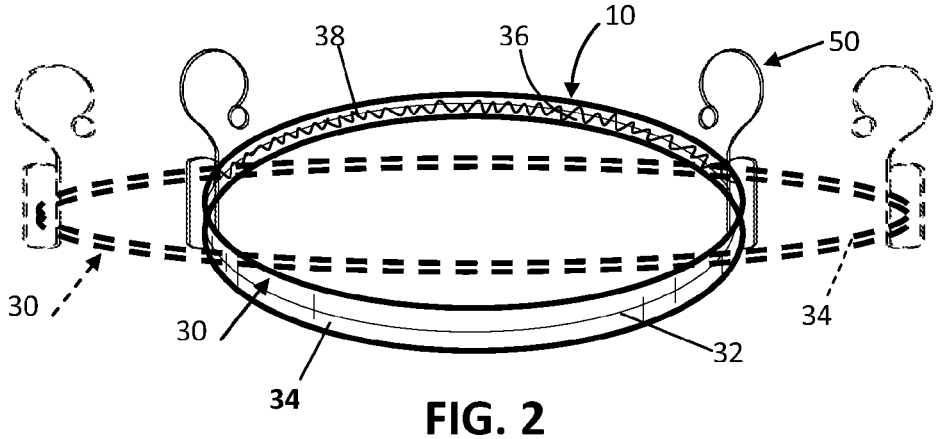
FIG. 2 is a perspective view of a device showing resiliency of a band.

FIG. 2 shows that the band is constructed of resilient material and can be stretched between the FIG. 2 circular i.e., solid-line) condition to FIG. 2 oval (i.e., phantom-line) condition so that the band can be conformed to the shape of trash can having various shapes like circular, rectangular etc.

Figure 4A:
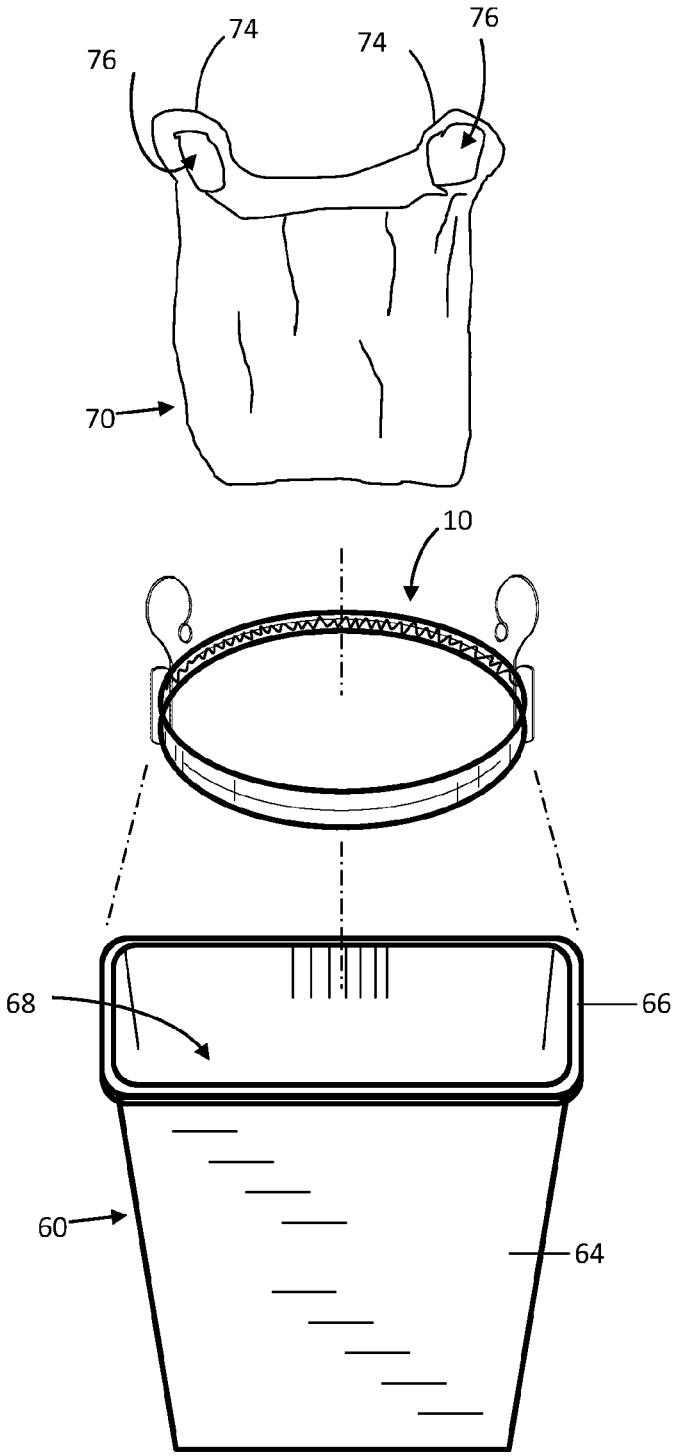
FIG. 4A is an exploded environmental view of a device according to present invention.
Figure 4B:
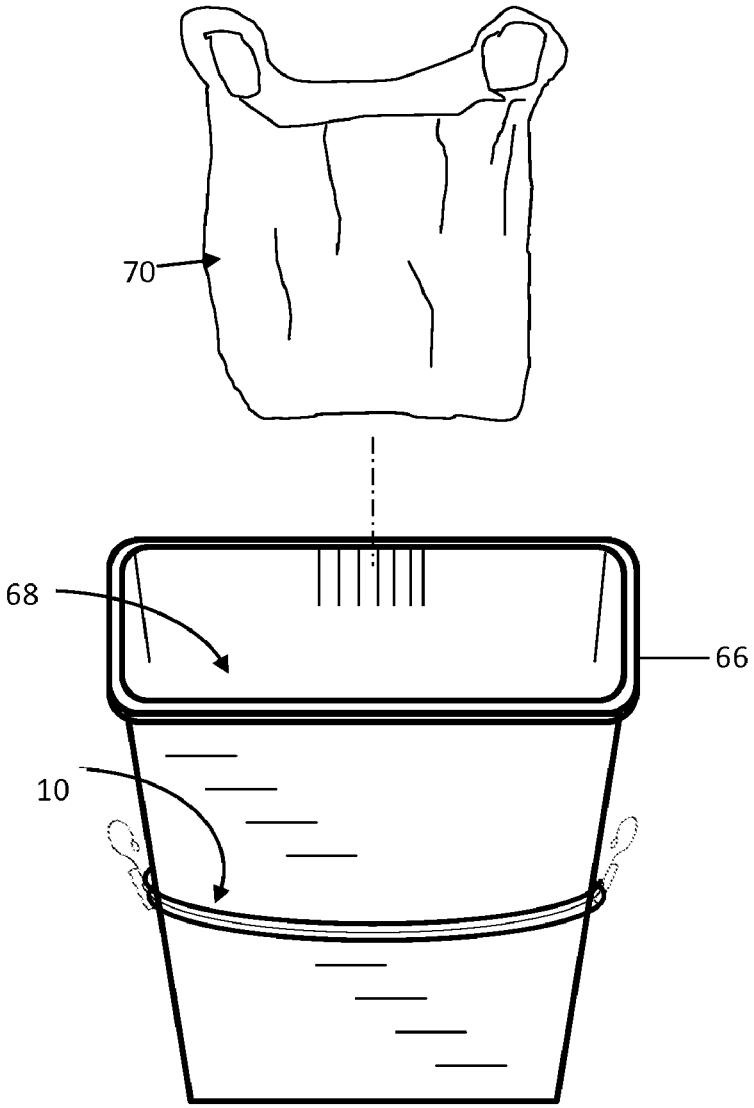
FIG. 4B is an another exploded environmental view of a device according to present invention.
Figure 4C:
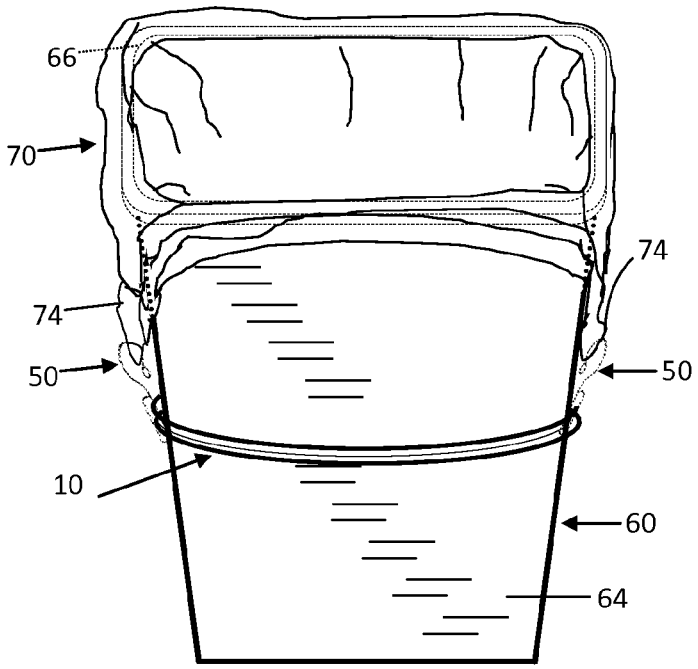
FIG. 4C is an another exploded environmental view of a device according to present invention.
Figure 5:
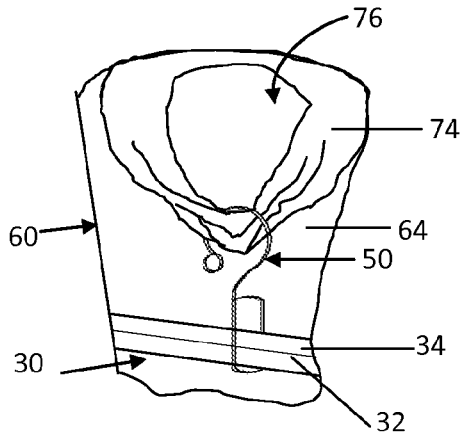
FIG. 5 shows a close-up of a bag handle secured by a hook of the present invention.

FIGS. 4A-4C show a device 10 in use with a refuse receptacle 60 to prevent the bag 70 from collapsing inside a refuse receptacle 60. As shown in FIG. 4A, the refuse receptacle 60 has rim 66. When not stretched, the band 30 has a circumference less than that of the rim 66. The band 30 is capable of being stretched around a refuse receptacle 60 to fit snuggly around the perimeter of refuse receptacle 60 disposing hooks 50 outwardly from the axis 32 of band 30. As shown in FIG. 4A, a bag 70 having handles 74 formed at its open end by circular cutouts 76. As shown in FIGS. 4B-4C, a bag 70 is inserted within the inner cavity 68 of refuse receptacle 60 such that the bag 70 folded over a rim 66 and handles 74 of bag 70 are hooked up in the gap 54 of hook 50 to secure the bag and prevent it collapsing inside the refuse receptacle 60, FIG. 5 shows a close-up of one of the bag handles 74 secured by a hook 50.

Figure 6:
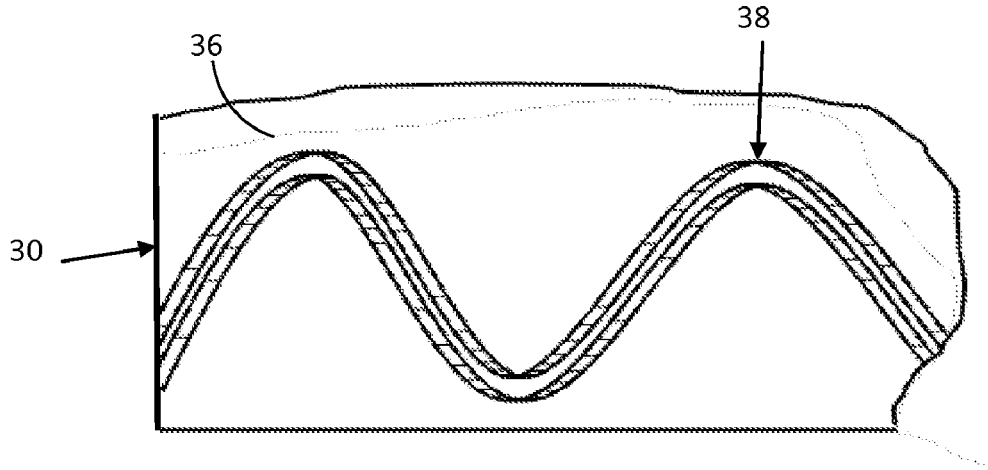
FIG. 6 shows a close-up of non-slip coating in wave pattern on an inner surface of the band.
Figure 7:
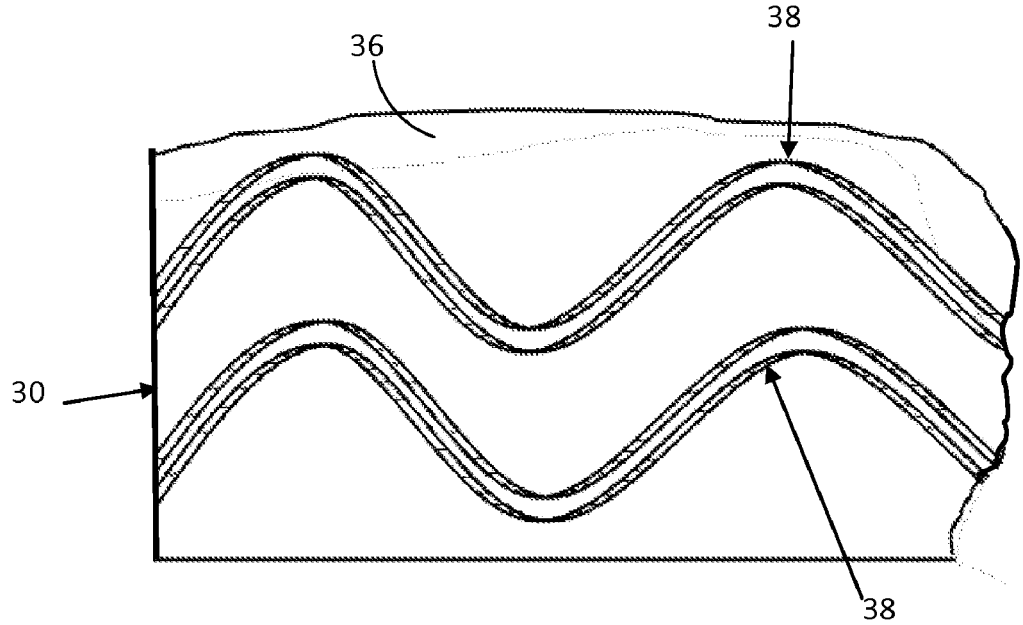
FIG. 7 shows a close-up of plurality of non-slip coating in wave pattern on an inner surface of the band.

FIG. 6 shows a close-up of non-slip coating 38 of silicone material in preferably wave pattern which prevents the band 30's inner surface 36 from slipping over an outer surface 64 of refuse receptacle 60 thus helps in keeping the band 30 in place over an outer surface 64 of refuse receptacle 60. FIG. 7 shows yet another embodiment of band 30 having plurality of non-slip silicone coating 38 in preferably wave pattern.

This disclosure provides exemplary embodiments of the present invention. The scope of present invention is not limited by these exemplary embodiments. For instance, the hook 50 can have variety of shapes furthermore hook 50 can be fixed at any point around the axis 32 of the band 30 or be allowed to move freely around the axis 32 of the band 30 without departing from the spirit of the invention. Furthermore, the band 30 could comprise a non-continuous band and not depart from the spirit of invention.

What is claimed is:

1. A device for preventing a bag with handles from collapsing inside a refuse receptacle having a wall which defines a top rim and inner and outer surfaces, the top rim portion defining a refuse receptacle mouth, the device comprising:

a band of resilient material defining an axis; the band being extensible about the outer surface of the refuse receptacle in a manner circumscribing the outer surface; and at least one hook suspended from the band, the hook having a gap for securing the handles of a bag suspended from the mouth of the refuse receptacle so that the bag with its handles is pulled against the opposite sides of the refuse receptacle thus securing the bag within refuse receptacle and preventing the bag from collapsing inside the refuse receptacle;

the hook moves freely along the axis of the band.

2. The device of claim 1 wherein the said band comprises of continuous loop.

3. The device of claim 1 wherein the said band having inner and outer surfaces.

4. The device of claim 3 wherein the said inner surface of band having plurality of non-slip coating of resilient material.

5. The device of claim 1 wherein the said hook having a gap for securing the handles of a bag.

6. The device of claim 1 wherein a plurality of said hooks are suspended from the axis of the band.

7. The device of claim 6 wherein a plurality of said hooks move freely on the axis of the said band.

* * * * *